US006632258B1

(12) United States Patent
Wheelock et al.

(10) Patent No.: US 6,632,258 B1
(45) Date of Patent: Oct. 14, 2003

(54) COAL BENEFICIATION BY GAS AGGLOMERATION

(75) Inventors: Thomas D. Wheelock, Ames, IA (US); Shen Meiyu, Philadelphia, PA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/527,451

(22) Filed: Mar. 17, 2000

Related U.S. Application Data

(60) Provisional application No. 60/124,630, filed on Mar. 16, 1999.

(51) Int. Cl.[7] ..... C10L 9/00

(52) U.S. Cl. ..... 44/620; 44/621; 44/625; 44/627

(58) Field of Search ..... 44/620, 621, 625, 44/627; 209/173

(56) References Cited

U.S. PATENT DOCUMENTS 4,436,617 A * 3/1984 Moore et al. ..... 209/10
4,482,460 A * 11/1984 Kandler et al. ..... 423/461
4,516,980 A * 5/1985 Wheelock
4,537,599 A * 8/1985 Greenwald, Sr.
5,032,257 A * 7/1991 Kulkarni ..... 209/10
5,249,688 A * 10/1993 Hwang ..... 209/170
5,368,617 A * 11/1994 Kindig ..... 44/622

* cited by examiner

*Primary Examiner*—Margaret Medley
(74) *Attorney, Agent, or Firm*—Mark LaMarre; Thomas Anderson; Paul A. Gottlieb

(57) ABSTRACT

Coal beneficiation is achieved by suspending coal fines in a colloidal suspension of microscopic gas bubbles in water under atmospheric conditions to form small agglomerates of the fines adhered by the gas bubbles. The agglomerates are separated, recovered and resuspended in water. Thereafter, the pressure on the suspension is increased above atmospheric to deagglomerate, since the gas bubbles are then re-dissolved in the water. During the deagglomeration step, the mineral matter is dispersed, and when the pressure is released, the coal portion of the deagglomerated gas-saturated water mixture reagglomerates, with the small bubbles now coming out of the solution. The reagglomerate can then be separated to provide purified coal fines without the mineral matter.

20 Claims, 7 Drawing Sheets

EFFECT OF AIR SATURATION PRESSURE ON THE AGGLOMERATION OF PITTSBURG NO. 8 COAL.

EFFECT OF AIR SATURATION PRESSURE ON THE AGGLOMERATION OF UPPER FREEPORT COAL.

EFFECT OF GAS TYPE ON THE AGGLOMERATION OF PITTSBURG NO. 8 COAL.

EFFECT OF GAS TYPE ON THE AGGLOMERATION OF UPPER FREEPORT COAL.

EFFECT OF i-OCTANE ON THE AGGLOMERATION OF PITTSBURG NO. 8 COAL.

EFFECT OF i-OCTANE CONCENTRATION ON THE AGGLOMERATION OF UPPER FREEPORT COAL.

COAL BENEFICIATION BY GAS AGGLOMERATION

PRIORITY

This application claims priority from Provisional Application No. 60/124,630 filed on Mar. 16, 1999. This application was filed during the term of the before-mentioned Provisional Application

GRANT REFERENCE

The research for the invention described herein was funded in part by a Department of Energy grant, DE-FG-26-97FT97261. As a result, the government may have certain rights in this invention.

FIELD OF THE INVENTION

This invention relates to the separation of coal from its associated mineral matter, resulting in nearly pure coal and less pollution potential.

BACKGROUND OF THE INVENTION

Most coal naturally contains some inorganic mineral matter in the form of small particles which are widely disseminated throughout the coal structure. The mineral matter generally includes various types of clay, silica, carbonate minerals, and iron pyrite. It may also contain toxic trace elements such as mercury. When coal is burned, the mineral matter is largely converted to metal oxides in the form of ash. However, the sulfur is released as sulfur oxides, and mercury is also volatilized. While it is advantageous to burn clean coal in order to limit environmental pollution, highly cleaned coal is seldom available because of the limitations of present coal cleaning methods.

Physical coal cleaning requires crushing the material to liberate the mineral particles, followed by particle separation. Coarse particles are readily separated by methods which take advantage of the difference in density of the organic material and the inorganic minerals. Fine particles are much more difficult to separate, and are generally separated by methods based on surface properties. The most commonly employed fine particle separation method is froth flotation. In this method, fine hydrophobic coal particles in an aqueous suspension become attached to gas bubbles which rise to the surface of the suspension and are collected in a thick layer of froth which is skimmed off. Most mineral particles are hydrophilic and remain in the aqueous suspension. The optimum particle size for froth flotation appears to be between 50 and 140 mesh (0.3 mm and 0.105 mm). However, newer versions of the method employ tall flotation columns and can treat coal particles having a mean diameter of about 25 $\mu$m.

A promising alternative fine particle separation process is one based on selective oil agglomeration of coal particles in an aqueous suspension. Almost any hydrocarbon liquid which is completely immiscible with water can be used to agglomerate the coal. If a large amount of oil is used (e.g., 30 to 50% based on coal weight), relatively large agglomerates are produced which can be recovered on a screen. The method can be used to recover particles which are much smaller than those recoverable by froth flotation. By grinding coal to micrometer size and selectively agglomerating the organic particles with a large amount of pentane, super clean coal has been produced experimentally. Although oil agglomeration methods are technically feasible, they have seldom been used commercially because of the cost of oil.

In summary, disadvantages with froth flotation are that the particle sizes are generally required to be larger than occurs with some coal fines, and disadvantages of the oil agglomeration process include that it requires significant amounts of costly oils. There is a need, therefore, for a process which can be used with very fine particles to separate mineral matter from coal, and for a process which does not involve use of large amounts of agglomerating oil.

Several years ago in our research we demonstrated an alternative agglomeration method in which hydrophobic particles in an aqueous suspension are bound together by small gas bubbles to form agglomerates (J. Drzymala and T. D. Wheelock, "Air agglomeration of hydrophobic particles," in: *Processing of Hydrophobic Minerals and Fine Coal*, J. S. Laskowski and G. W. Poling (eds.), Canadian Institute of Mining, Metallurgy and Petroleum, Montreal, Canada, 1995, pp. 201–211). We found that various hydrophobic materials, including Teflon, gilsonite, graphite and sulfur can be agglomerated by this method. Further, coal which had been treated with a small amount of heptane to make its surface more hydrophobic could also be agglomerated. We then found a brief mention of a similar form of agglomeration by A. F. Taggert, (*Elements of Ore Dressing*, Wiley, New York, 1951). However, in spite of the fact that the phenomenon of agglomeration of oiled mineral particles by small gas bubbles was reported long ago, it does not appear to have been developed or used in a reversible multi-stage process.

From the above description it can be seen that there is a real and a continuing need for a process which overcomes the disadvantages of froth flotation separation of minerals from coal fines, and the disadvantages of oil agglomeration processes. In particular, there is a real and a continuing need for a process which can effectively separate minerals from very fine coal particles without the need for use of large amounts of agglomerating oil. This invention has as its primary objective the fulfillment of this need.

Another objective of the present invention is to provide a gaseous agglomeration of coal particles in an aqueous suspension by a process which allows extremely small particles to be separated without requiring much agglomerating oil.

A further objective of the present invention is to provide a process meeting the above-described objectives which can be practiced on either a batch or a continuous multi-stage process.

The method and manner of accomplishing each of the above objectives as well as others will become apparent from the detailed description of the invention which follows hereinafter.

SUMMARY OF THE INVENTION

Figure 1:
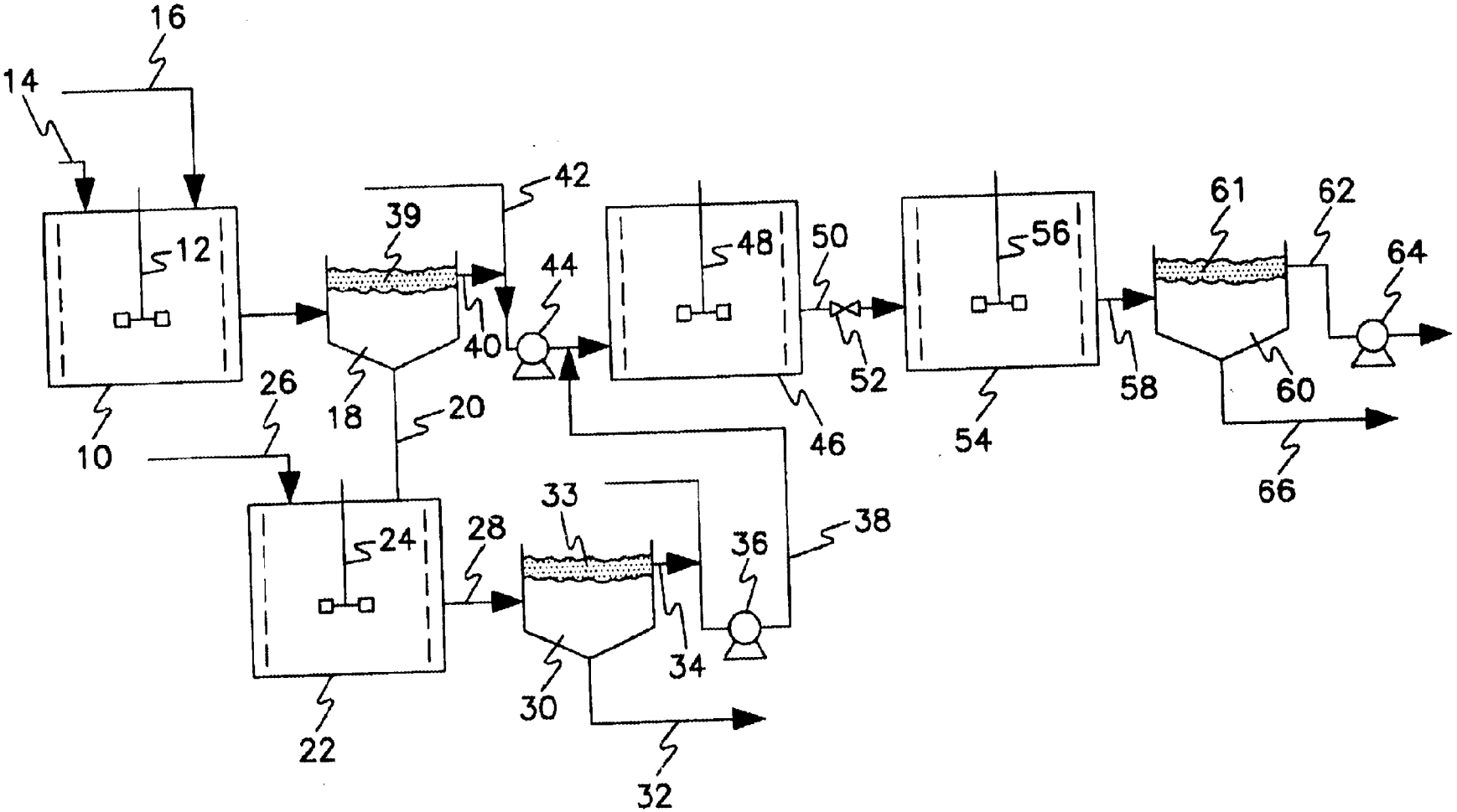
FIG. 1 is a flow sheet for a continuous multi-stage gas agglomeration process utilizing the present process.

Coal beneficiation is achieved by suspending coal fines in a colloidal suspension of microscopic gas bubbles in water under atmospheric conditions to form small agglomerates of the fines adhered by the gas bubbles. The agglomerates are separated, recovered and resuspended in water. Thereafter, the pressure on the suspension is increased above atmospheric to deagglomerate, since the gas bubbles are then re-dissolved in the water. During this second deagglomeration step, the mineral matter is dispersed, and when the pressure is released, the coal portion of the deagglomerated gas-saturated water mixture reagglomerates, with the small bubbles now coming out of the solution. The reagglomerate can then be separated to provide purified coal fines without the mineral matter.

DETAILED DESCRIPTION OF THE INVENTION

As earlier referenced, according to the process of the present invention, the agglomeration of ultra-fine size coal particles is achieved in an aqueous suspension by means of microscopic gas bubbles. In particular, microscopic gas bubbles are generated by saturating the water used for suspending fine coal particles with gas under pressure, and then the pressure is reduced. Microagglomerates are produced which appear to consist of gas bubbles encapsulated in coal particles. The rate of agglomeration depends on the concentration of the microscopic gas bubbles.

In accordance with the process of the invention, one starts with coal fines which can be obtained from a suitable source. The objective, of course, is to remove the mineral material from the fines. It has been found that by following the process of this invention in many cases over 90% of the mineral material can be removed, and in many instances the mineral material can be reduced to at least as low as 6% in the remaining coal fines.

In accordance with the first process step of the invention, the coal fines are suspended in an aqueous or water system that has dissolved inert gases in it. The purpose of the inert gases is, of course, to form the microbubbles which as later explained assist in the formation of the coal agglomerates. The inert gas can be air, nitrogen or carbon dioxide. The preferred gas is simply air. The amount of gas dissolved in the water should be 0.003% to 0.015% w/w %. A dissolved gas concentration of this magnitude can be achieved by saturating water at 20° C. with air under a partial pressure of 5 to 50 psig or with carbon dioxide under a partial pressure of 2 to 5 psig. When the pressure is released subsequently to atmospheric, a colloidal suspension of microscopic gas bubbles is produced. The coal particles containing mineral matter are usually of a size of from 1 micron to 75 microns, and typically from 1 micron to 25 microns. These are then suspended in the water containing the colloidal suspension of gas bubbles under atmospheric conditions. Alternatively, the microbubbles can be generated by saturating an already formed aqueous suspension of coal particles with gas under pressure and then releasing the pressure. The microbubbles in the water seem to act as an adhering medium, with the result being that the microbubbles act with the coal fines to form agglomerates.

In accordance with the process, it is preferred that the water suspension contain from about 1.0% by weight to about 15.0% by weight coal fines, preferably from about 1% to about 10% by weight coal fines. In addition, for purposes of stabilizing the microbubbles, the addition of a very small stabilizing effective amount of a hydrocarbon film former enhances the microbubble stability. Such a film former can be a $C_5$ to $C_8$ hydrocarbon with isooctane being preferred. The amount of stabilizing hydrocarbon film former is generally from 0.1% to 5.0%, and most preferably from 0.3% to 3.0% based upon the weight of coal.

In the next step of the process of the present invention, the aqueous suspension is separated to recover the agglomerates from the unagglomerated mineral particles. Then the agglomerates are resuspended in water and then deagglomerated. Typically, the aqueous suspension is in a mixing tank, and the pressure is increased from atmospheric pressure to within the range of from 5 psig to 50 psig, typically from 10 psig to 30 psig. As the pressure is increased, the equilibrium of the water/gas system is shifted, and the gas is forced back into solution in the water. The result is that the particles become deagglomerated which releases coal particles and trapped mineral particles. Then the pressure is released to atmospheric which shifts the water/gas equilibrium and the dissolved gas comes out of solution again producing microbubbles, which reagglomerate the coal fines. While some mineral particles may be entrapped in the new agglomerates, the quantity of entrapped particles will be much lower than before because the reagglomeration takes place in a suspension having a much lower concentration of mineral particles than was present during the first stage of agglomeration. The new agglomerates with fewer entrapped mineral particles are separated from the remaining material by transferring the entire suspension to a settling tank where the agglomerates float to the surface and are skimmed off while the unagglomerated mineral particles sink and are withdrawn as tailings. The result is demineralized coal fines with, in many cases, more than 90% of the coal recovered, and in most instances with the amount of mineral material reduced to a few percent or less based on the weight of recovered coal.

The process can be performed as a batch process as illustrated in some of the examples below, or it can be performed as a continuous multi-stage process as shown in FIG. 1.

In particular, in FIG. 1 mixing tank 10 is held at atmospheric pressure and has within it mixer 12. Lines 14 and 16 leads into tank 10. Line 14 is for introduction of coal fines and water, and line 16 for introduction of a gaseous emulsion of air, the stabilizing hydrocarbon such as isooctane, if one is used, and water. Mixing occurs in tank 10 usually for a time of ten to thirty minutes, or until physical inspection reveals that agglomeration has occurred. After successful agglomeration in tank 10, the material is pumped into separator 18, which is a settling tank. As illustrated, separator 18 has a drain line 20 for removing material that sinks to the bottom, which then goes to mixing tank 22, having mixer 24 and entrance line 26. Tank 22 is of similar construction to tank 10. More air and water and oil emulsion mixture is introduced through line 26 into tank 22, and mixing again occurs for approximately 10 to 30 minutes to produce additional agglomerates. Thereafter, via drain line 28, the suspension of agglomerates from mixing tank 22 is transferred into separator 30. In this instance, the tailings 32 are removed and discarded. The suspended agglomerated coal fines 33 are drawn off via line 34 and pumped via pump 36 and line 38 back into the system for reprocessing.

Turning back to separator tank 18, agglomerated coal fines 39 are withdrawn at 40, mixed with more water from line 42, and pumped via pump 44 into deagglomeration tank 46, having a mixer 48. The tank is completely filled with the aqueous suspension to avoid having any gas present other than the gas introduced with the agglomerates. Within deagglomeration tank 46, the pressure is increased to within the range of from 5 psig to 50 psig, preferably 10 psig to 30 psig, while mixing is occurring. This results in the gas being redissolved in the water. The slurry is then pumped out via line 50, which has pressure release valve 52. When the pressure is released to atmospheric, the material being pumped into reagglomeration tank 54, now at ambient pressure, reagglomerates as the mixing via mixer 56 occurs. The process of destroying the agglomerates in tank 46 and reagglomerating them in 56 is a re-cleaning process. The agglomerates are then conveyed out of tank 54 via line 58 into separator tank 60. The reagglomerated product 61 is then pumped out via line 62 and pump 64, and the tailings are drawn off via line 66.

As can be seen from FIG. 1, there is provided a continuous multi-stage gas agglomeration separation process with the ability to continuously feed coal and water and emulsion into the system at one end, employing a multi-stage agglomeration, deagglomeration, re-cleaning and reagglomeration process, with the result being removal of tailings and cleaned product at the other end. When this process is employed, often 90% of the coal fines are recovered, and the amount of mineral matter removed in the tailings typically leaves only 6% or less of such material in the purified, reclaimed coal fines.

Although agitated mixing tanks are shown in FIG. 1 for conducting the steps of agglomeration and deagglomeration, and settling tanks are shown for separating agglomerates from unagglomerated particles, alternative equipment can be used for conducting these operations. For example, pipeline mixers designed to provide turbulent flow condition can be substituted for mixing tanks, and centrifugal particle concentrators can be substituted for settling tanks. A centrifugal particle concentrator separates small particles which vary in density by application of centrifugal force which can be many times greater than the force of gravity prevailing in a settling tank. Therefore, a much higher rate of particle separation can be achieved by a centrifugal concentrator.

The following examples are offered to further illustrate, but not limit, the process of the present invention.

EXAMPLES

To demonstrate the gas agglomeration method, a bench scale processing system (FIG. 2) was assembled for conducting batch agglomeration tests. A key component of this system was a vertical cylindrical mixing tank 68 which was completely enclosed so that it could be pressurized. The tank 68 had an inside diameter of 11.43 cm and inside height of 11.43 cm. The tank 68 was fitted with four vertical baffles 70 attached to the inner surface of the tank 68. Each baffle 70 projected inward a distance of 0.95 cm. The top 72 and bottom 74 of the tank were enclosed by flat, aluminum flanges. The rest of the tank 68 was made of clear Plexiglas. The mixing tank 68 was equipped with a variable speed agitator 76 which included a single turbine impeller 78 mounted on a centrally located, vertical drive shaft that was connected to a ⅛ hp motor. The impeller 78 had six vertical blades mounted on a horizontal disc; the overall diameter of the impeller was 3.65 cm.

Figure 2:
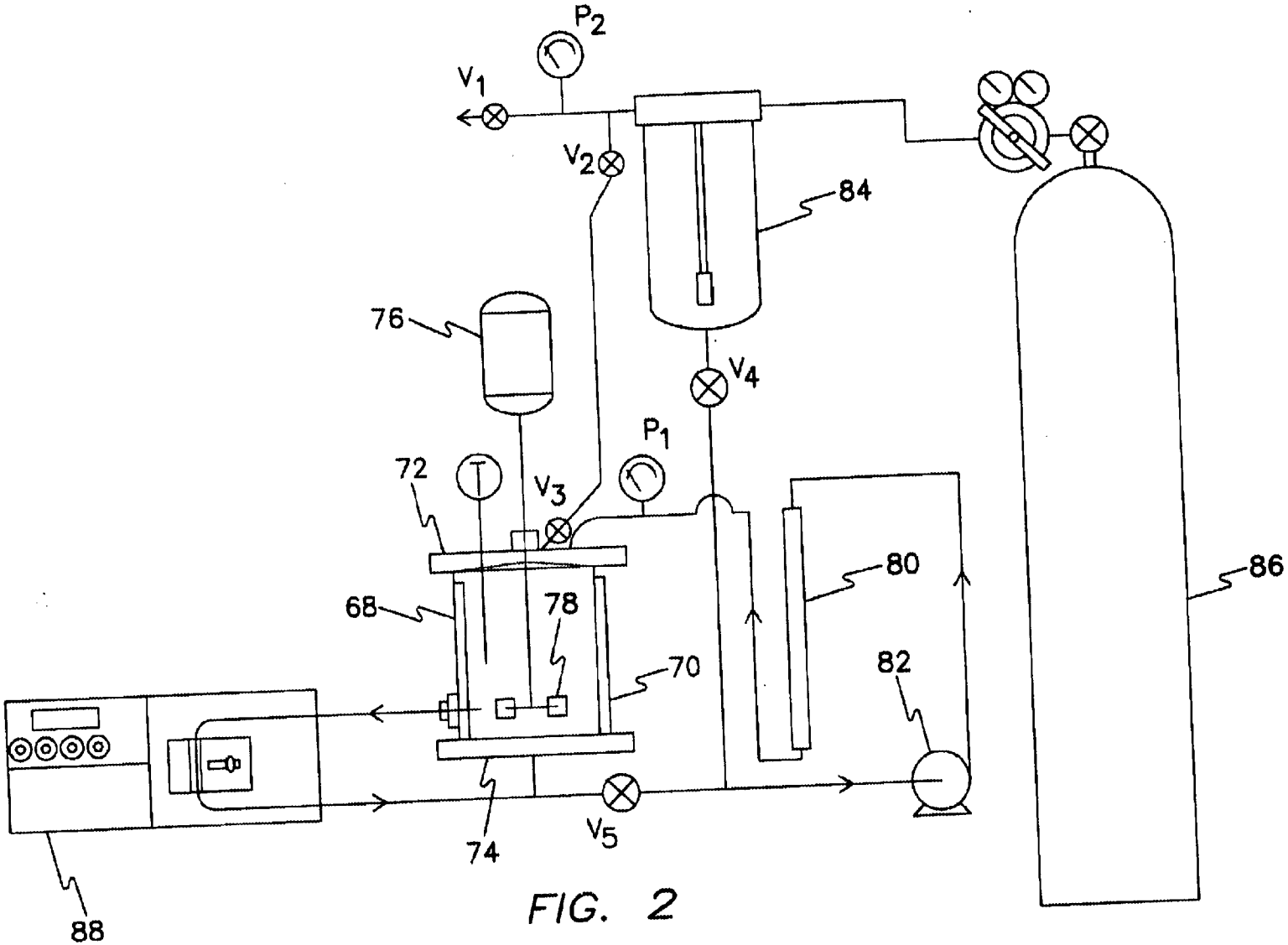
FIG. 2 shows an experimental system for investigating the influence of gas bubble concentration on coal particle agglomeration.

In addition to the mixing tank 68, the processing system included other equipment shown in FIG. 2. This equipment included a coal storage tank 80 in which the slurried feed material was placed prior to an agglomeration test and a circulation pump 82 used for introducing feed into the mixing tank. It also included an elevated surge tank 84 in which water was placed for saturation with a compressed gas 86 before an agglomeration test, and it included a photometric dispersion analyzer (PDA) 88 used for measuring the turbidity of a particle suspension undergoing agglomeration.

Coal for the agglomeration tests was obtained from two sources. One source was the Pittsburgh No. 8 coal seam in Belmont County, Ohio, and the other source was the Upper Freeport coal seam in Indiana County, Pa. Coal samples were crushed in stages and then ground as a concentrated slurry in a stirred ball mill to produce particles having a projected area mean particle diameter of 4 $\mu$m for the Pittsburgh coal and 5 $\mu$m for the Upper Freeport coal. After grinding, the slurry was partially dewatered and stored as a paste at a temperature of approximately 5° C. to minimize surface oxidation of the particles. The surface of the Pittsburgh coal was moderately hydrophobic, while the surface of the Upper Freeport coal was more hydrophobic.

Example 1

To demonstrate the fundamental characteristics and reversibility of the gas agglomeration method, an experiment was conducted in which agglomeration was monitored by observing changes in the turbidity of a coal particle suspension. Monitoring was possible since the turbidity of a particle suspension is proportional to the number of particles per unit volume or the number concentration. Consequently as the particles combined to form agglomerates, their effective concentration decreased, causing the turbidity to decrease. For convenience, the results of the agglomeration experiment are reported in terms of the relative turbidity change ($\Delta\tau_r$) in percent as defined below.

$$\Delta\tau_r=[(\tau_o-{}_o)/\tau_o]100$$

In this equation $\tau_o$ represents the initial turbidity of an unagglomerated suspension and $\tau$ represents the turbidity after some agglomeration has taken place. As agglomeration takes place and the absolute turbidity decreases, the relative turbidity will increase.

For this experiment the water used to fill the mixing tank was first saturated at room temperature (24° C.) with air under a gauge pressure of 15 psig. Enough of the air-saturated water was added to the mixing tank to completely fill it. Next 0.28 ml i-octane was dispersed in the water by agitation at 2000 rpm, and the pressure in the mixing tank was reduced from 15 psig to 0 psig over a period of 30–60 s which created a fog-like colloidal dispersion of microscopic gas bubbles encapsulated in i-octane. Soon thereafter a concentrated slurry of Pittsburgh coal particles was pumped from the coal storage tank into the mixing tank as agitation was continued at 2000 rpm. The amount of coal introduced was 11 g on a dry basis which provided a solids concentration of 1 w/w % for agglomeration. The amount of i-octane introduced initially corresponded to a concentration of 1.7 w/w % based on the weight of coal present.

Figure 3A:
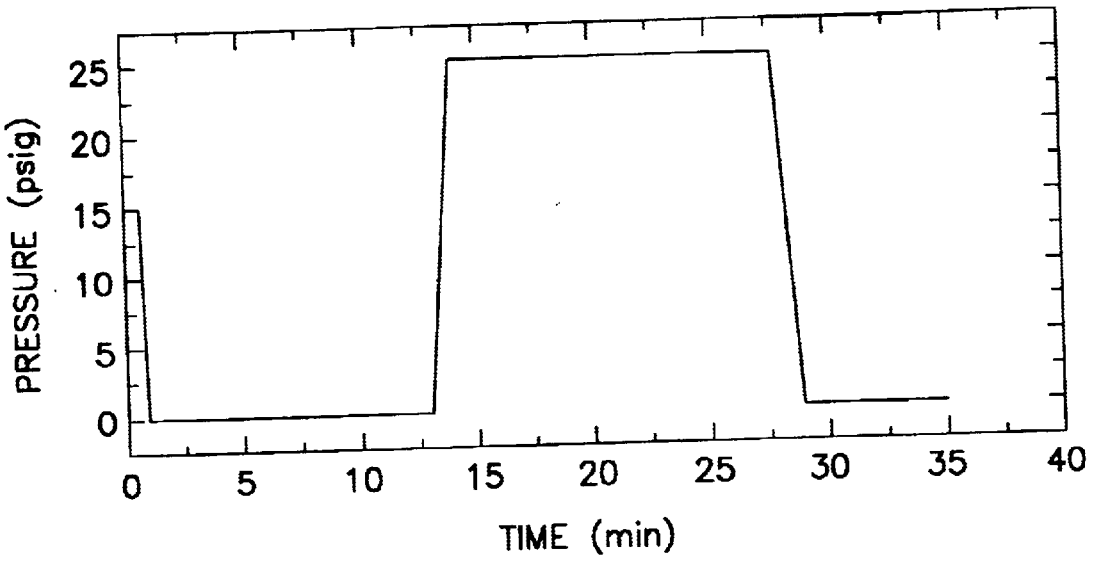
FIGS. 3A and 3B are graphs showing the effect of changes in system pressure on the relative turbidity changes caused by agglomerating particles treated with 2.5% v/w % i-octane at 2000 rpm in the experimental system.
Figure 3B:
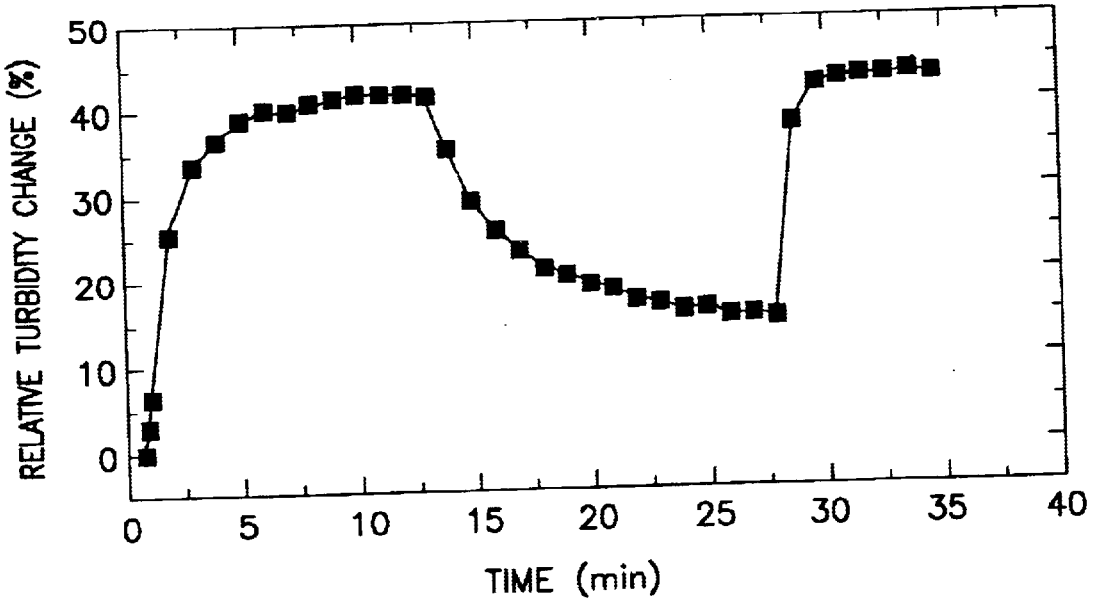

Particle agglomeration commenced almost as soon as the coal slurry entered the mixing tank. This result was indicated by a rapid increase in the relative turbidity change as shown in FIG. 3B. Within a period of about 10 min. the relative turbidity change reached a value of 42% and became constant, indicating completion of agglomeration. Shortly thereafter the system pressure was raised to 25 psig which caused the air bubbles in the coal suspension to redissolve, and that in turn destroyed agglomerates as indicated by the decrease in relative turbidity change. The system pressure was then reduced again to 0 psig which caused the particles to reagglomerate with a corresponding increase in the relative turbidity change. These pressure changes and corresponding changes in the relative turbidity of the coal suspension are both indicated by FIGS. 3A and 3B.

This experiment showed that the coal particle agglomerates were held together by microscopic gas bubbles, and therefore microscopic gas bubbles had to be provided to produce agglomerates. The experiment also showed that the process was reversible since coal could be deagglomerated by subjecting the agglomerated particle suspension to a pressure that was high enough to redissolve the microscopic gas bubbles. Therefore, it was possible to control agglomeration and deagglomeration by manipulating the system pressure.

Example II

Figure 4:
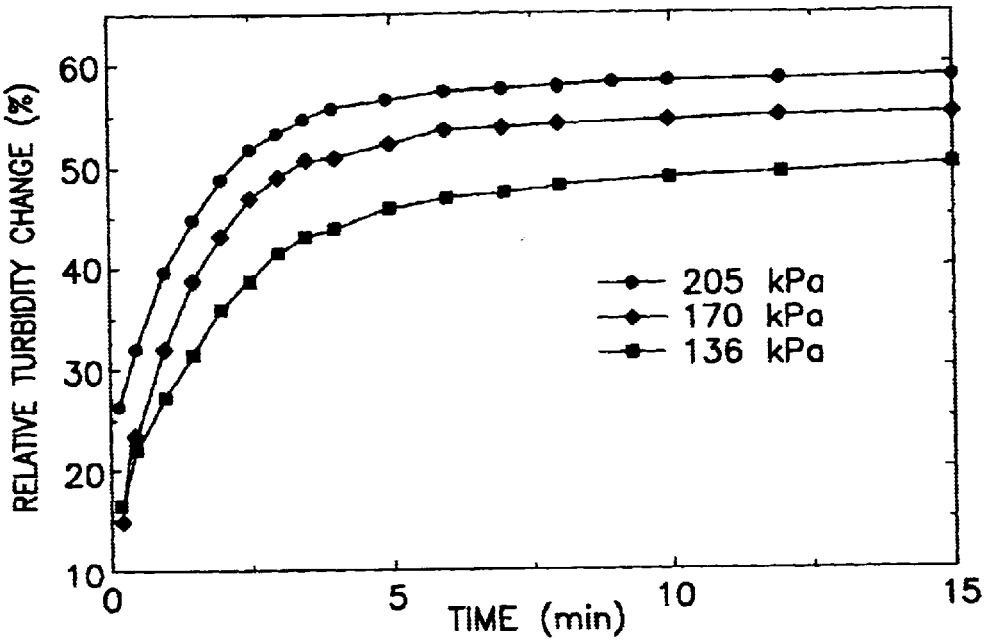
FIG. 4 is a graph of Relative Turbidity Change vs. Time for Pittsburgh No. 8 coal, illustrating the effect of air saturation pressure.
Figure 5:
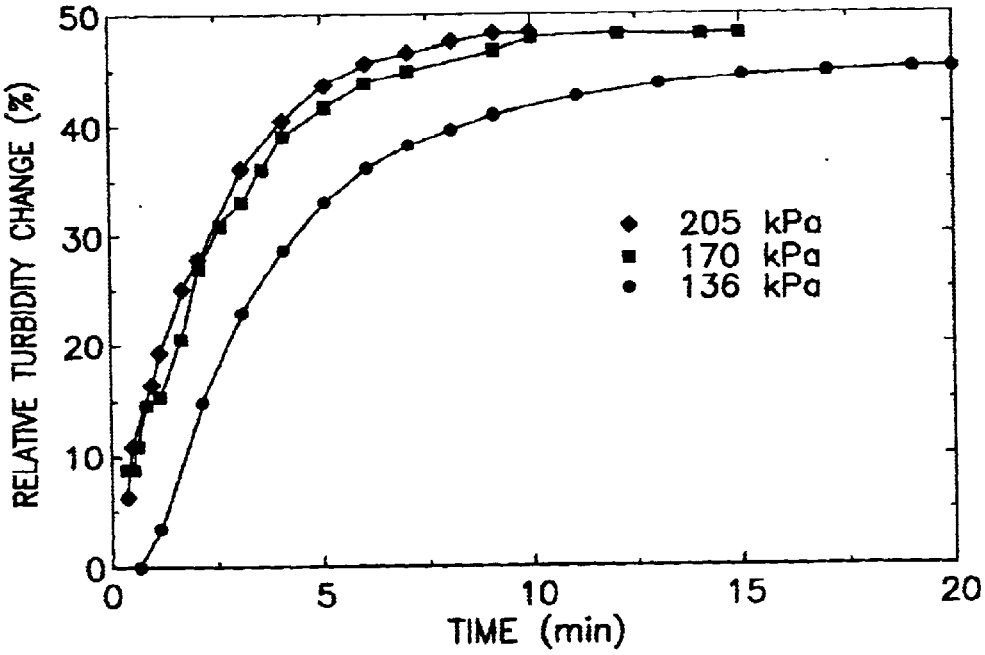
FIG. 5 is a graph of Relative Turbidity Change vs. Time for Upper Freeport coal, illustrating the effect of air saturation pressure.

Additional tests were conducted with both types of coal to study the effect of gas bubble concentration on the apparent rate of agglomeration. The gas bubble concentration was varied among runs by saturating the water with air at different pressures, since the dissolved gas concentration would have been directly proportional to pressure according to Henry's Law. In each case the gas-saturated water was treated with enough i-octane to provide a concentration of 2.5 v/w % based on the weight of coal. After the pressure was reduced to atmospheric, coal was introduced and agglomeration proceeded at a rate which appeared to reflect the initial gas concentrations (FIGS. 4 and 5). It can be seen that the $\Delta\tau_r$ reached during the first 5 min. rose with increasing gas saturation pressure. Also it is apparent that increasing the saturation pressure from 136 kPa to 170 kPa (5 to 10 psig) had a greater effect than increasing the saturation pressure from 170 kPa to 205 kPa (10 to 15 psig).

Figure 6:
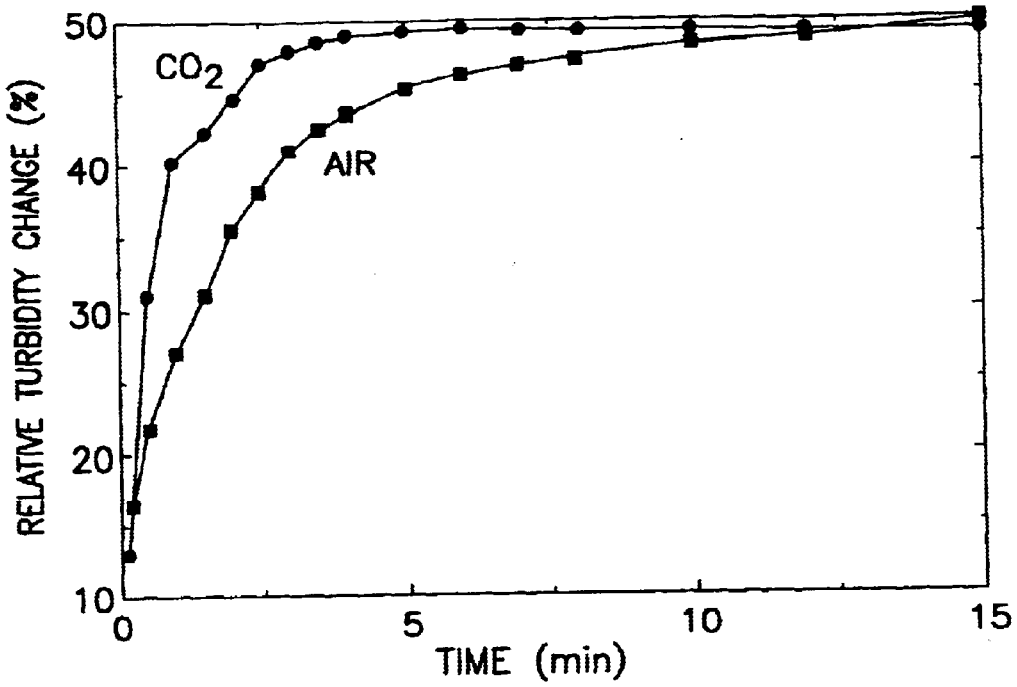
FIG. 6 is a graph of Relative Turbidity Change vs. Time for Pittsburgh No. 8 coal, illustrating the effect of gas type.
Figure 7:
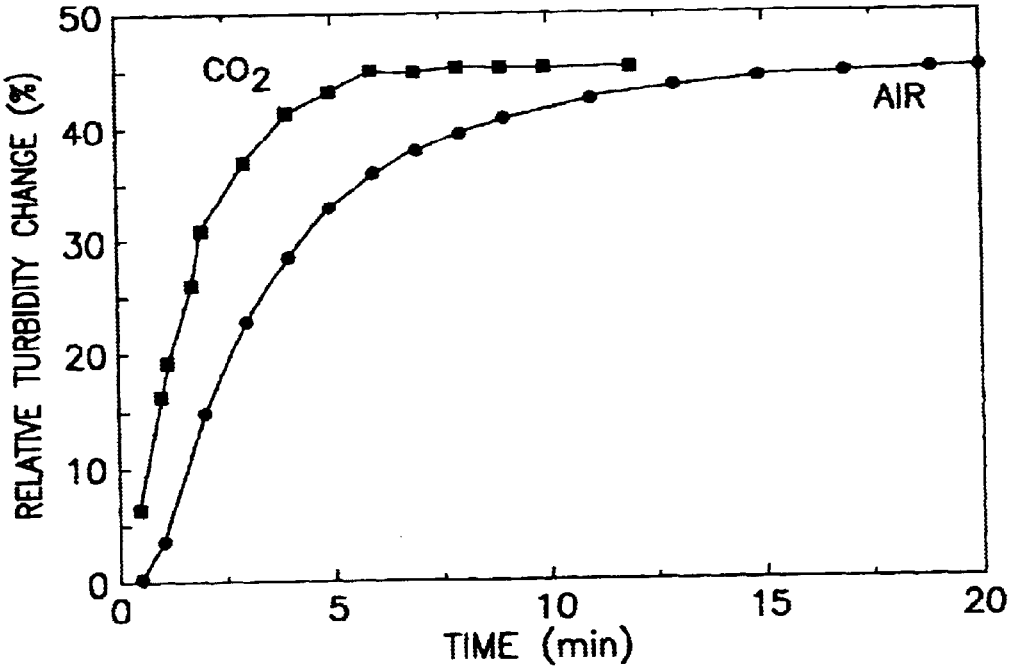
FIG. 7 is a graph of Relative Turbidity Change vs. Time for Upper Freeport coal, illustrating the effect of gas type.

The effect of gas concentration on the apparent rate of agglomeration was also observed by comparing the results of tests made under similar conditions except for the type of gas. In one case the water was first saturated with air at 136 kPa (5 psig) while in another case the water was first saturated with carbon dioxide under similar conditions. Since carbon dioxide is much more soluble than air in water, the dissolved gas concentration was much higher when carbon dioxide was employed. For these tests an i-octane concentration of 2.5 v/w % was employed. The results achieved with Pittsburgh coal are shown in FIG. 6 and those achieved with Upper Freeport coal in FIG. 7. In both cases, the apparent rate of agglomeration was greater with carbon dioxide than with air because of the greater concentration of carbon dioxide.

To see whether the concentration of i-octane had an effect on the apparent rate of agglomeration, the concentration was varied between tests made under similar conditions.

Figure 8:
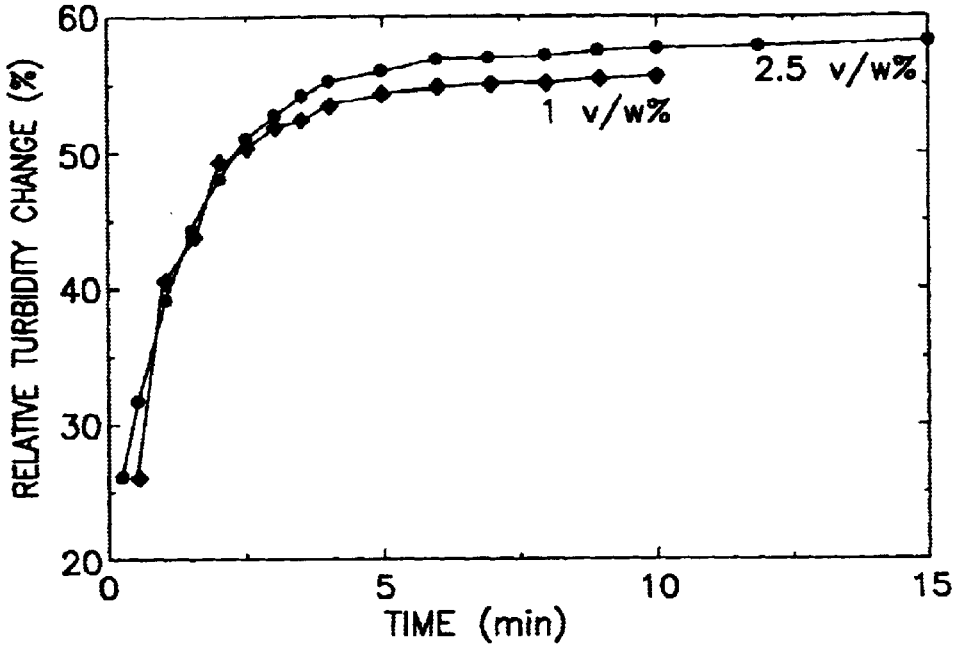
FIG. 8 is a graph of Relative Turbidity Change vs. Time for Pittsburgh No. 8 coal, illustrating the effect of i-octane concentration on agglomeration.
Figure 9:
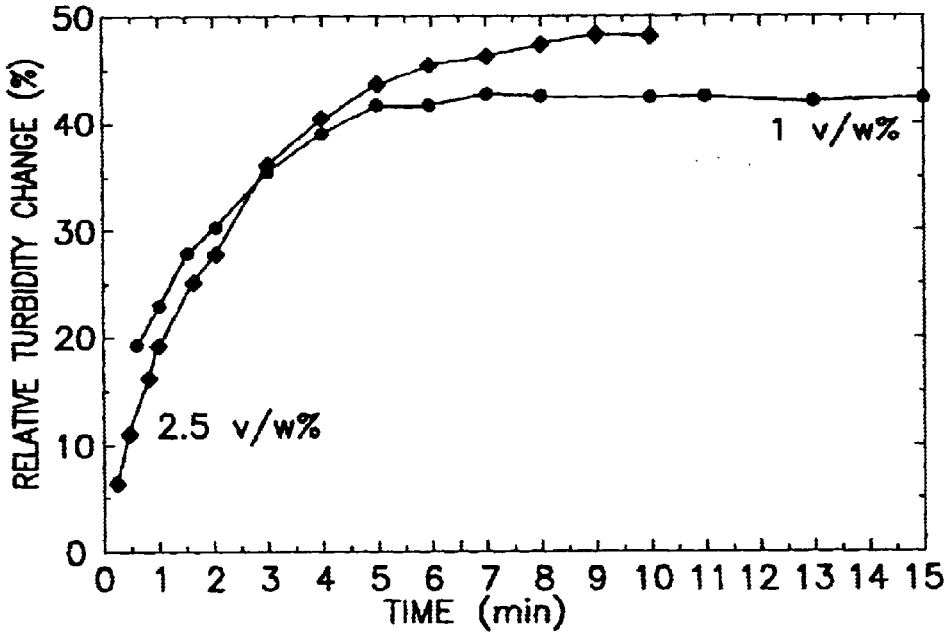
FIG. 9 is a graph of Relative Turbidity Change vs. Time for Upper Freeport coal, illustrating the effect of i-octane concentration on agglomeration.

For these tests the water was first saturated with air at 205 kPa (15 psig). The results obtained with the different types of coal are indicated by FIGS. 8 and 9, respectively. The results suggest that the rate was affected only slightly by i-octane concentration, since the change in $\Delta\tau_r$ during the first 10 min. was only slightly greater with 2.5 v/w % i-octane than with 1 v/w %.

Example III

Agglomeration Tests with More Concentrated SusDensions

A large number of agglomeration tests were conducted with coal suspensions containing from 3 to 9 w/w % solids. Since the particle concentration was too large for the accurate measurement of turbidity, the results were evaluated by determining the recovery and ash content of the agglomerated product together with the ash rejection in the tailings. This required separating the agglomerates from the tailings after each test by allowing the materials to settle.

The agglomeration tests were conducted with both Pittsburgh coal and Upper Freeport coal using the system shown in FIG. 2, but dispensing with the photometric dispersion analyzer (PDA). The coals were finely ground as previously described. The Pittsburgh coal had an ash content of 26.0 wt. % and the Upper Freeport coal an ash content of 25.6 wt. %, both on a dry basis. An aqueous suspension of the Pittsburgh coal had a natural pH of 6.8, whereas a similar suspension of the Upper Freeport coal had a natural pH of 5.7. The lower pH of the Upper Freeport coal suspension suggests that the surface of some of the coal's constituents may have become oxidized. This possibility was reinforced by the further observation that a suspension of a more recent sample of Upper Freeport coal had a natural pH of 6.8. Preliminary agglomeration tests with the earlier sample, which will be labeled UPF(A), showed that much better results were achieved when the pH of the aqueous suspension was raised to 10 by adding a small amount of sodium carbonate to the suspension. Raising the pH increased the dispersion of the mineral particles so that fewer were entrapped in the coal agglomerates, and therefore, the product had a lower ash content. The effect of raising the pH was much less pronounced for Pittsburgh coal since the natural pH of a suspension of this material was almost neutral to begin with.

The agglomeration tests were conducted by mixing a concentrated coal slurry with an emulsion of microscopic gas bubbles which had been prepared by saturating water with air under pressure, adding a small amount of i-octane, and then releasing the pressure. After agitating the suspension for either 10 or 30 min., the material was transferred to a special settling chamber and allowed to separate. The product and tailings were recovered subsequently and analyzed.

The results achieved with Upper Freeport coal are presented in Table 1 and those achieved with Pittsburgh coal in Table 2. The agitator speed N, solids concentration and pH of the suspension, and i-octane concentration based on the weight of coal are indicated for each test. Also shown are the agitation time and the air pressure used for saturating the water. Both the absolute air pressure in kPa and the gauge pressure in psig are indicated. The results are expressed in terms of the ash content of the agglomerated product, ash rejection to tailings, and coal recovery in agglomerates. The recovery represents the ratio of coal recovered to coal supplied, both expressed on a dry, ash-free basis.

A review of the tabulated data indicates that the results were not always consistent nor reproducible. However, it proved possible to classify many of the test results into self-consistent groups which are listed in Table 3. Within each group similar results were observed with respect to product ash content and coal recovery. All of the test results included in this table were obtained with an agitator speed of 2000 rpm and a suspension pH of 10. The results of the two tests within group A showed that the ash content of UPF(A)

TABLE 1

Experimental conditions and results of single stage, batch agglomeration tests with Upper Freeport coal, UPF(A), and i-octane.

| Test No. | N, rpm | Solids, w/w % | i-Oct. v/w % | Air press. kPa | Air press. psig | pH | Time, min. | Ash, w/w % | Ash Rej., % | Recov., % |
|---|---|---|---|---|---|---|---|---|---|---|
| 112 | 2000 | 1 | 2.5 | 205 | 15 | 5.7 | 15 | 11.59 | 77.5 | 88.6 |
| 117 | 2000 | 3 | 2.7 | 205 | 15 | 10 | 30 | 9.86 | 72.6 | 85.2 |
| 118 | 2000 | 3 | 0.9 | 205 | 15 | 10 | 30 | 6.38 | 83.8 | 81.8 |
| 119 | 2000 | 3 | 0.4 | 205 | 15 | 10 | 30 | 7.00 | 84.9 | 66.3 |
| 120 | 2000 | 3 | 0.4 | 205 | 15 | 10 | 30 | 9.46 | 76.0 | 82.1 |
| 121 | 1500 | 3 | 0.9 | 205 | 15 | 5.7 | 30 | 19.00 | 57.3 | 61.5 |
| 122 | 2000 | 3 | 0.4 | 136 | 5 | 10 | 30 | 9.64 | 74.3 | 84.8 |
| 123 | 2000 | 3 | 0.2 | 115 | 2 | 10 | 30 | 9.40 | 80.4 | 65.0 |
| 124 | 2400 | 3 | 0.9 | 205 | 15 | 10 | 30 | 9.70 | 72.1 | 89.5 |
| 125 | 1500 | 3 | 0.9 | 205 | 15 | 10 | 30 | 9.08 | 73.9 | 88.8 |
| 126 | 2000 | 5 | 0.5 | 136 | 5 | 10 | 30 | 10.39 | 73.9 | 79.1 |
| 127 | 2000 | 5 | 1.0 | 205 | 15 | 10 | 30 | 11.06 | 67.5 | 90.1 |
| 128 | 2000 | 5 | 0.5 | 205 | 15 | 10 | 30 | 11.30 | 66.8 | 90.6 |
| 129 | 2000 | 5 | 0.5 | 205 | 15 | 10 | 30 | 8.50 | 79.8 | 75.5 |
| 131 | 2000 | 3 | 0.4 | 136 | 5 | 10 | 30 | 8.80 | 77.1 | 84.2 |
| 134 | 2000 | 3 | 0.9 | 205 | 15 | 10 | 30 | 6.92 | 88.2 | 86.9 |
| 135 | 2000 | 5 | 1.0 | 136 | 5 | 10 | 30 | 11.76 | 64.9 | 90.4 |
| 136 | 2000 | 3 | 0.9 | 136 | 5 | 10 | 30 | 8.65 | 77.1 | 84.8 |
| 137 | 2000 | 5 | 0.5 | 205 | 15 | 10 | 30 | 10.74 | 68.6 | 89.9 |
| 138 | 2000 | 3 | 0.4 | 205 | 15 | 10 | 30 | 8.90 | 76.4 | 83.6 |
| 182 | 2000 | 9 | 1.0 | 205 | 15 | 10 | 10 | 12.00 | 74.5 | 59.5 |
| 183 | 2000 | 9 | 2.0 | 205 | 15 | 10 | 10 | 15.48 | 60.4 | 79.7 |
| 184 | 2000 | 9 | 2.0 | 239 | 20 | 10 | 10 | 15.87 | 54.6 | 85.1 |

TABLE 2

Experimental conditions and results of single stage, batch agglomeration tests with Pittsburgh No. 8 coal and i-octane.

| Run No. | N, rpm | Solids, w/w % | i-Oct. v/w % | Air press. kPa | Air press. psig | pH | Time, min. | Ash, w/w % | Ash Rej., % | Recov., % |
|---|---|---|---|---|---|---|---|---|---|---|
| 130 | 2000 | 5 | 1.0 | 136 | 5 | 10 | 30 | 5.94 | 86.5 | 77.3 |
| 132 | 2000 | 5 | 1.0 | 205 | 15 | 10 | 30 | 5.32 | 87.9 | 75.4 |
| 139 | 2000 | 3 | 0.9 | 205 | 15 | 10 | 10 | 7.95 | — | — |
| 140 | 2000 | 3 | 2.7 | 136 | 5 | 6.8 | 10 | 6.04 | 84.3 | 84.8 |
| 141 | 2000 | 3 | 0.4 | 136 | 5 | 10 | 10 | 5.76 | 92.5 | 42.6 |
| 141a | 2000 | 3 | 0.4 | 136 | 5 | 6.8 | 10 | 6.08 | 85.8 | 71.9 |
| 142 | 2000 | 5 | 2.4 | 205 | 15 | 6.8 | 10 | 8.86 | 76.0 | 85.4 |
| 143 | 2000 | 3 | 2.7 | 136 | 5 | 6.8 | 10 | 7.62 | 84.1 | 65.5 |
| 144 | 2000 | 5 | 0.5 | 136 | 5 | 6.8 | 10 | 8.04 | 82.6 | 66.8 |
| 145 | 2000 | 3 | 0.4 | 205 | 15 | 6.8 | 10 | 6.72 | 84.4 | 71.6 |
| 146 | 2000 | 5 | 0.5 | 136 | 5 | 6.8 | 10 | 7.50 | 83.7 | 69.6 |
| 147 | 2000 | 3 | 0.4 | 205 | 15 | 6.8 | 10 | 6.97 | 86.8 | 60.1 |
| 148 | 2000 | 3 | 2.7 | 205 | 15 | 6.8 | 10 | 6.64 | 82.8 | 88.7 |
| 149 | 2000 | 5 | 0.5 | 205 | 15 | 6.8 | 10 | 7.77 | 87.0 | 55.8 |
| 150 | 2000 | 5 | 0.5 | 136 | 5 | 6.8 | 10 | 9.50 | 84.7 | 52.3 |
| 151 | 2000 | 3 | 2.7 | 136 | 5 | 6.8 | 10 | 9.25 | 80.9 | 68.2 |
| 152 | 2000 | 5 | 2.4 | 205 | 15 | 6.8 | 10 | 8.15 | 88.3 | 47.5 |

TABLE 3

A summary of consistent results of single stage batch agglomeration tests with different coals and i-octane.

| Group I.D. | Test No. | Coal Type | Solids, w/w % | i-Oct., v/w % | Air press. kPa | Air press. psig | pH | Time, min. | Ash, wt. % | Ash Rej., % | Coal Rec., % |
|---|---|---|---|---|---|---|---|---|---|---|---|
| A | 118 | UPF(A) | 3 | 0.9 | 205 | 15 | 10 | 30 | 6.38 | 83.8 | 81.8 |
| A | 134 | UPF(A) | 3 | 0.9 | 205 | 15 | 10 | 30 | 6.92 | 88.2 | 86.9 |
| B | 131 | UPF(A) | 3 | 0.4 | 136 | 5 | 10 | 30 | 8.80 | 77.1 | 84.2 |

TABLE 3-continued

A summary of consistent results of single stage batch agglomeration tests with different coals and i-octane.

| Group I.D. | Test No. | Coal Type | Solids, w/w % | i-Oct., v/w % | Air press. kPa | Air press. psig | pH | Time, min. | Ash, wt. % | Ash Rej., % | Coal Rec., % |
|---|---|---|---|---|---|---|---|---|---|---|---|
| B | 122 | UPF(A) | 3 | 0.4 | 136 | 5 | 10 | 30 | 9.64 | 74.3 | 84.8 |
| B | 120 | UPF(A) | 3 | 0.4 | 205 | 15 | 10 | 30 | 9.46 | 76.0 | 82.1 |
| C | 137 | UPF(A) | 5 | 0.5 | 205 | 15 | 10 | 30 | 10.74 | 68.6 | 89.9 |
| C | 128 | UPF(A) | 5 | 0.5 | 205 | 15 | 10 | 30 | 11.30 | 66.8 | 90.6 |
| C | 135 | UPF(A) | 5 | 1.0 | 136 | 5 | 10 | 30 | 11.76 | 64.9 | 90.4 |
| C | 127 | UPF(A) | 5 | 1.0 | 205 | 15 | 10 | 30 | 11.06 | 67.5 | 90.1 |
| D-1 | 182 | UPF(A) | 9 | 1.0 | 205 | 15 | 10 | 10 | 12.00 | 74.5 | 59.5 |
| D-2 | 183 | UPF(A) | 9 | 2.0 | 205 | 15 | 10 | 10 | 15.48 | 60.4 | 79.7 |
| D-3 | 184 | UPF(A) | 9 | 2.0 | 239 | 20 | 10 | 10 | 15.87 | 54.6 | 85.1 |
| E | 130 | Pitts. | 5 | 1.0 | 136 | 5 | 10 | 30 | 5.94 | 86.5 | 77.3 |
| E | 132 | Pitts. | 5 | 1.0 | 205 | 15 | 10 | 30 | 5.32 | 87.9 | 75.4 |

coal was reduced from an initial value of 25.6 wt. % to a final value of 6.65 wt. % on average by using a solids concentration of 3 w/w % and an i-octane concentration of 0.9 v/w %. At the same time a coal recovery of 84.4% on average was achieved. For the same solids concentration, the results of three tests within group B showed that a reduction in i-octane concentration to 0.4 v/w % produced an increase in product ash content to 9.3 wt. % on average and an insignificant decrease in coal recovery to 83.7% on average. The results of the tests within group B did not seem to be affected significantly by a change in air saturation pressure within the range of 136 to 205 kPa (5 to 15 psig).

When UPF(A) coal was used in a higher solids concentration (5 w/w %) for the four tests included in group C, the product ash content increased to 11.2 wt. % on average and coal recovery increased to 90.3% on average. Consequently, less ash forming material was rejected in the tailings than was observed with the lower solids concentration. With the 5 w/w % solids concentration, the results were not affected by a variation in either the i-octane concentration over a range of 0.5 to 1.0 v/w % or the air saturation pressure over a range of 136 to 205 kPa (5 to 15 psig).

When UPF(A) coal was used in 9 w/w % solids concentration, the results of the three tests included in group D showed a further increase in product ash content over the previous results. The results of the different tests also suggest that coal recovery depended on both i-octane concentration and air saturation pressure. Consequently, an increase in i-octane concentration from 1.0 v/w % to 2.0 v/w % seemed to cause an increase in coal recovery from 59.5% to 79.7%. Moreover when 2.0 v/w % i-octane was used, an increase in air saturation pressure seemed to produce an increase in recovery from 79.7% to 85.1%. These trends suggest that with 9 w/w % solids, the concentration of microbubbles became a limiting factor, whereas with 5 w/w % solids or less such was not the case.

The results of two tests with Pittsburgh coal included in group E showed that with a solids concentration of 5 w/w % the coal recovery and product ash content tended to be somewhat lower than for Upper Freeport coal. As in the case of Upper Freeport coal, the results did not seem to be affected by a change in air saturation pressure.

Example IV

To provide additional insight and a better understanding of the gas agglomeration method, another experiment was conducted with the system shown in FIG. 2. Upper Freeport coal with an ash content of 35 wt. % was used for this experiment. The mixing tank was first filled with water which had been saturated with air under a pressure of 15 psig. As the system was agitated at 2000 rpm, 0.5 ml of i-octane was introduced and dispersed. Then the system pressure was lowered gradually to 0 psig which produced a colloidal dispersion of microscopic gas bubbles and created a fog-like appearance. A concentrated coal slurry which had been prepared previously and placed in the coal storage tank was pumped into the mixing tank, and the resulting suspension was stirred for 10 min. Agitation was stopped and virtually all of the coal particles floated to the top of the mixing tank while the lighter colored mineral particles remained suspended throughout the tank. Microscopic examination of the floating material produced in other tests under similar conditions showed that such material consisted largely of 0.05 to 0.10 mm diameter spherical agglomerates. Next the system pressure was raised to 27 psig and the contents of the mixing tank were stirred at 2000 rpm for 5 min. After agitation stopped, virtually all of the coal particles settled to the bottom of the tank showing that the agglomerates had been destroyed. Agitation was resumed, and the system pressure was released gradually. After 5 min. of additional stirring, agitation was stopped again, and most of the coal floated to the top of the tank as before.

The results showed that microscopic gas bubbles were an integral part of the agglomerated material since it floated. Furthermore, they showed that the agglomerates were destroyed when the bubbles were eliminated by increasing the system pressure and redissolving the gas. When agitation was stopped; the deagglomerated coal settled to the bottom of the tank. Again, it was shown that agglomeration and deagglomeration could be controlled by varying the system pressure.

The quantity of coal used for this experiment was 35 g on a dry basis which provided a solids concentration of 3 w/w % during agglomeration. The quantity of i-octane corresponded to a concentration of 1 w/w % based on the weight of coal. The coal suspension was made slightly alkaline to improve the dispersion of mineral particles. This was accomplished by adding a small amount of sodium carbonate which raised the suspension pH to 10.

Example V

Figure 10:
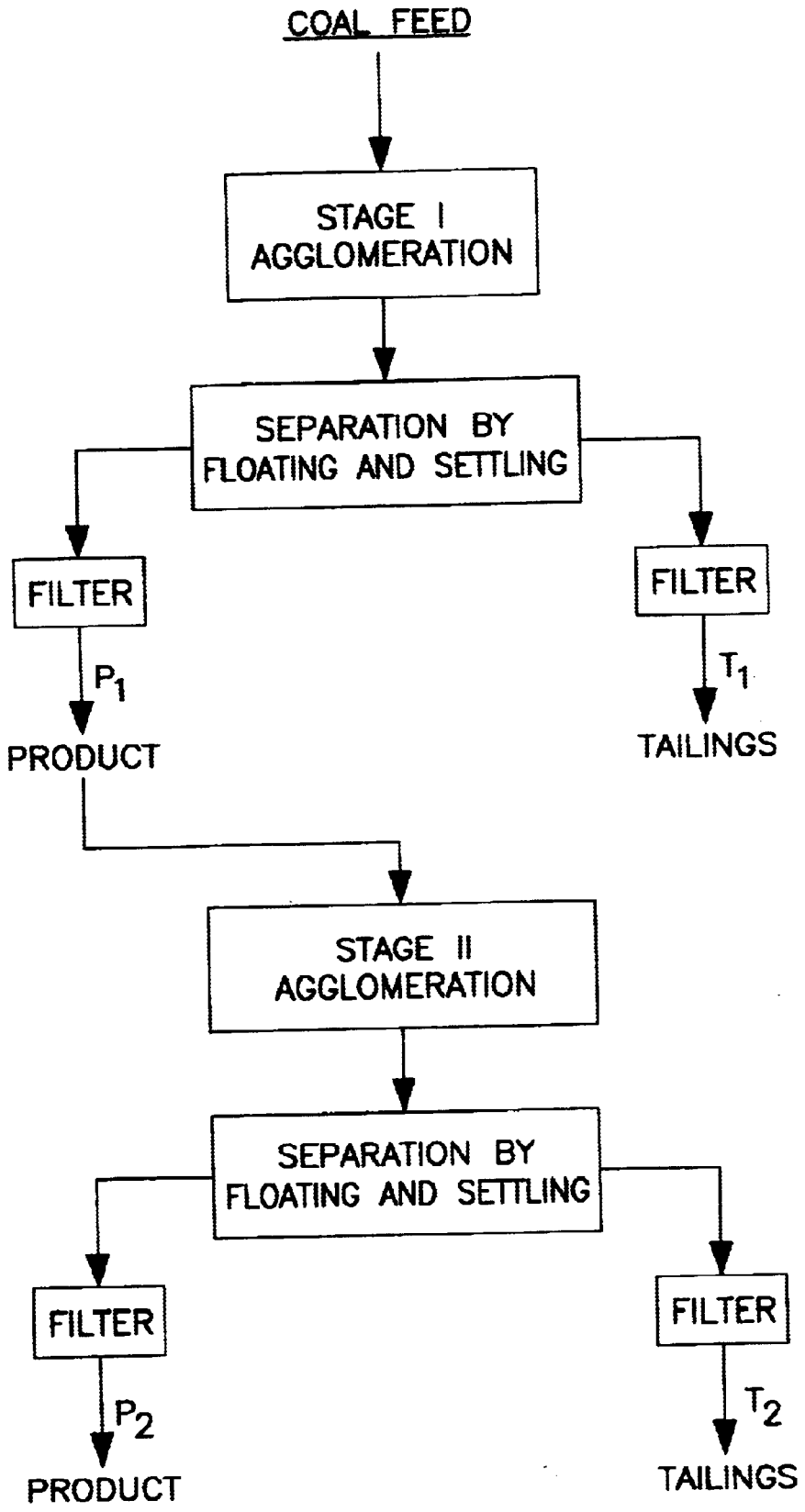
FIG. 10 is a flow sheet for a two-stage agglomeration process.

To demonstrate the utility of the gas agglomeration method and how it can be applied for either single stage or multistage coal cleaning, several batch agglomeration tests were conducted in which the agglomerates were separated from the unagglomerated particles, and both products were analyzed to provide an indication of the degree of coal recovery as well as quality and the extent of rejection of ash-forming mineral matter. These tests were conducted with the system shown in FIG. 2 using Upper Freeport seam coal having an ash content of 33.0 wt. % on a dry basis. The general scheme for conducting these tests is shown in FIG. 10. Some of the tests were carried through the first stage of agglomeration, separation, and recovery, while other tests were carried through two complete stages.

For conducting the first stage of agglomeration, the mixing tank was first filled completely with deionized water which had been saturated with gas under a pressure of 15 psig at room temperature (22–24° C.). After an agitator speed of 2000 rpm was established, a measured amount of pure i-octane was introduced. The mixture was conditioned for 1–2 min., and then the pressure was reduced to 0 psig which allowed the dissolved gas to come out of solution in the form of microscopic bubbles. A concentrated coal slurry was then introduced quickly from the coal storage tank so as to provide an ultimate solids concentration of 3.0 w/w %. Particles started to agglomerate immediately, and as agglomeration proceeded, the agitator speed was held at 2000 rpm and the temperature of the suspension was kept close to room temperature by circulating water through a cooling coil attached to the bottom of the mixing tank. Agitation was continued for 10 min. At the end of this time, agitation was stopped, and the suspension was transferred to a special settling chamber where the agglomerates were allowed to rise to the surface and the mineral particles were allowed to sink to the bottom over a period of several hours. The layer of agglomerates was removed from the settled suspension and dewatered by vacuum filtration, and the remaining suspension was also filtered to recover the unagglomerated mineral matter. For a test involving only a single stage of agglomeration, the filter cakes were dried, weighed, and analyzed for ash content.

For a test involving a second agglomeration stage, the moist filter cake of agglomerated coal particles was not dried and instead was mixed with water to form a concentrated slurry which was returned to the coal storage tank. The mixing tank was refilled with water which had been saturated with gas at only 5 psig. The concentrated coal slurry was then pumped into the mixing tank, displacing an equal volume of water. The system pressure was increased subsequently to 25 psig to redissolve the gas bubbles holding the agglomerates together. To aid the destruction of the agglomerates and release of trapped mineral particles, the suspension was stirred at 2000 rpm. After several minutes of agitation, 0.10 ml of i-octane was introduced and the pressure was reduced gradually over 1 to 2 min. to release the dissolved gas and to reform the coal agglomerates. The suspension was stirred at 2000 rpm for another 5 min. to complete agglomeration. The agglomerates were subsequently separated and recovered using the same method as described above for single stage agglomeration.

For conducting these tests, a small amount of sodium carbonate was added to the coal slurry to provide a pH of 10 for the first stage of agglomeration. Since no more sodium carbonate was added before the second stage of agglomeration, the pH decreased to 7 for this stage. The total quantity of i-octane employed (0.50 ml) was the same for both the one stage and two stage batch tests. However, for a one stage test the entire amount was introduced in the first stage, whereas for a two stage test, 0.40 ml was introduced in the first stage and 0.10 ml in the second.

The results of one and two stage tests are indicated in Table 4. The first two tests were single stage, while the last two were two stage. For the single stage tests, the ash content is indicated for both the product $P_1$ and tailings $T_1$, while for the two stage tests, the ash content is shown for the product of the second stage $P_2$ and for the tailings from both the first and second stages, $T_1$ and $T_2$, respectively. It can be seen that the ash content of the coal was reduced from an initial value of 33.0 wt. % to a value of 10.4 wt. % on average by subjecting the coal to a single stage of agglomeration and separation, whereas by subjecting the coal to two stages of agglomeration and separation, the ash content was reduced to 6.3 wt. % on average. On the other hand, coal recovery on a dry, ash-free basis was 82.0% on average after two stages of agglomeration and separation compared to 88.7% on average after a single stage of agglomeration and separation. These values represent the percent of the coal supplied on a dry, ash-free basis which was recovered in the agglomerated product. To achieve a cleaner product by employing two stages, some additional coal was lost. This type of tradeoff is inherent in any type of coal cleaning process.

TABLE 4

Results of one and two stage batch agglomeration tests with Upper Freeport coal.

| | | Stage I Conditions | | | | Stage II Conditions | | | | Stage I Results | | | | Stage II Results | | | |
|---|---|---|---|---|---|---|---|---|---|---|---|---|---|---|---|---|---|
| Test No. | Coal Type | Solids, w/w % | Sol'n pH | i-Oct., w/w % | Air P, psig | Solids, w/w % | Sol'n pH | i-Oct., w/w % | Air P, psig | $P_1$ Ash wt. % | $T_1$ Ash, wt. % | Ash Rej. $T_1$, % | Coal Rec. $P_1$, % | $P_2$ Ash wt. % | $T_2$ ash, wt. % | Ash Rej. $T_2$, % | Coal Rec. $P_2$% |
| A1 | UPF(B) | 3 | 10 | 0.99 | 15 | — | — | — | — | 10.60 | 76.1 | 78.3 | 88.2 | — | — | — | — |
| A2 | UPF(B) | 3 | 10 | 0.99 | 15 | — | — | — | — | 10.20 | 77.5 | 78.6 | 89.2 | — | — | — | — |
| A3 | UPF(B) | 3 | 10 | 0.79 | 15 | 2.1 | 7 | 0.29 | 5 | — | 77.5 | 78.1 | — | 6.5 | 40.6 | 10.5 | 81.2 |
| A4 | UPF(B) | 3 | 10 | 0.79 | 15 | 2.0 | 7 | 0.29 | 5 | — | 77.1 | 80.3 | — | 6.1 | 44.4 | 8.8 | 82.8 |

Example VI

A concentrated suspension of finely ground coal in water is treated with an emulsion of microscopic gas bubbles in water in an enclosed agitated tank (Mix I) under ambient temperature and pressure to form coal microagglomerates (see FIG. 1). The emulsion is produced by first saturating the water with the gas under a partial pressure of 2 to 3 atm. and then releasing the pressure as the water is agitated. The emulsion is stabilized by having a small amount of liquid hydrocarbon such as heptane or i-octane present to coat the microscopic gas bubbles with a hydrocarbon film. Various gases can be employed, including air, nitrogen or carbon dioxide. In the case of air or nitrogen, a gas saturation pressure of 2 to 3 atm. is in order, whereas for carbon dioxide a much lower saturation pressure would be used because of the greater solubility of the gas in water.

After the microagglomerates are formed in the first mixing tank, the particle suspension is conducted to a settling tank or separator 18 where the gas agglomerated coal particles float to the surface and the bulk of the unagglomerated mineral particles sink to the bottom. Of course, some mineral particles will be trapped in the microagglomerates, and some coal particles will not be agglomerated and will sink with the mineral particles. Therefore, the products of the first separation stage are retreated to remove mineral particles from the agglomerated coal and to recover coal from the material which sinks.

The material which floats in the first separator is diluted with water and pumped into a second mixing tank 46 which is maintained under sufficient pressure (e.g., 2 to 3 atm.) to redissolve the gas bubbles holding the microagglomerates together. The microagglomerates are destroyed, which releases the coal particles and any mineral particles that were trapped with the coal. The resulting suspension is conducted to a third mixing tank 54 which operates at atmospheric pressure. Because of the reduced pressure, gas comes out of solution in the form of microscopic bubbles which bind the coal particles into microagglomerates. While a few mineral particles may be incorporated in the microagglomerates, the concentration of mineral particles will be much lower than before because fewer mineral particles will be present in the suspension.

After the microagglomerates are reformed in the third mixing tank 54, the particle suspension is conducted to a second settling tank 60, where the coal microagglomerates float to the surface and the mineral particles sink. The microagglomerates are skimmed from the surface of the settling tank to form a clean product, while the settled material is discarded as tailings.

Since the material which settles in the first separator 18 will contain some coal particles, it is treated with additional dissolved gas in another mixing tank 22 to recover the coal. The resulting suspension is separated in a settling tank 30. The material which floats is diluted with water and pumped into the second mixing tank 46 for recleaning. The material which sinks is discarded as tailings.

Although Example VI is of a multi-stage process with only a single recleaning stage and a single scavenging stage, it is apparent that additional stages can be incorporated in such a process if needed to achieve a very high recovery of very clean coal.

As illustrated in Examples I and IV, the data shows that the gas agglomeration process is reversible. Since agglomerates are formed when gas bubbles are present and disappear when the bubbles are redissolved under pressure, it is apparent that the agglomerates are held together by the small bubbles, and that the material in the system can be agglomerated, deagglomerated and reagglomerated simply by changing the pressure.

It can therefore be seen that the invention accomplishes at least all of its stated objectives.

What is claimed is:

1. A process of coal beneficiation by removing mineral impurities from coal fines, comprising:

suspending coal fines containing mineral impurities in a colloidal suspension of microscopic gas bubbles in water under atmospheric conditions to form small agglomerates comprised of coal fines, gas bubbles and trapped mineral impurities;

separating the agglomerates from the suspension of unagglomerated mineral impurities;

resuspending the agglomerates in water and increasing the pressure on the suspension above atmospheric pressure to deagglomerate said small agglomerates;

releasing the pressure on the deagglomerated suspension of coal fines and gas-saturated water to produce cleaned agglomerates comprised of coal fines, gas bubbles, and a lesser amount of trapped mineral impurities; and thereafter separating the cleaned coal agglomerates from the suspension of remaining unagglomerated particles.

2. The process of claim 1 wherein the colloidal suspension is from about 1.0% to 15.0% by weight coal fines.

3. The process of claim 2 wherein the colloidal suspension is from about 1% to about 10% by weight coal fines.

4. The process of claim 1 wherein the coal fine particles have a size of from 1 micron to 75 microns.

5. The process of claim 1 wherein the coal fine particles have a size of from 1 micron to 25 microns.

6. The process of claim 1 wherein the colloidal suspension of microscopic gas bubbles is prepared by saturating water with an inert gas under a partial pressure within the range of 2 psig to 50 psig, depending on the type of gas and water temperature, in order to provide a dissolved gas concentration with the range of 0.003% and 0.015% w/w %, and then reducing the system pressure to substantially atmospheric.

7. The process of claim 6 wherein the inert dissolved gas is selected from the group consisting of air, nitrogen, and carbon dioxide.

8. The process of claim 7 wherein the inert dissolved gas is air.

9. The process of claim 8 wherein water at ambient temperature is saturated with air under a partial pressure with the range of 5 to 50 psig.

10. The process of claim 7 wherein the inert dissolved gas is carbon dioxide.

11. The process of claim 10 wherein water at ambient temperature is saturated with carbon dioxide under a partial pressure within the range of 2 psig to 5 psig.

12. The process of claim 6 wherein the suspension of microscopic gas bubbles is prepared with the addition of a small amount of water immiscible hydrocarbon liquid capable of spreading at an air-water interface and forming a film surrounding each bubble and thereby stabilizing the bubble so as to prevent its coalescence with other bubbles.

13. The process of claim 12 wherein the stabilizing hydrocarbon film former is a $C_5$ to $C_8$ hydrocarbon.

14. The process of claim 13 wherein the stabilizing hydrocarbon film former is iso-octane.

15. The process of claim 12 wherein the amount of stabilizing hydrocarbon film former is 0.1% to 5.0% by weight of the amount of coal in said suspension.

16. The process of claim 15 wherein the amount of stabilizing hydrocarbon film former is from 0.3% to 3.0% by weight of said coal in said suspension.

17. The process of claim 1 wherein the suspension of coal agglomerates is deagglomerated by increasing the pressure on the system to a value greater than the gas partial pressure used to saturate the water in preparation of the colloidal suspension of microscopic gas bubbles.

18. The process of claim 17 wherein the suspension of coal agglomerates is deagglomerated by increasing the pressure on the system to a value which is 5 psig or more greater than the gas partial pressure used to saturate the water in preparation of the colloidal suspension of microscopic gas bubbles.

19. The process of claim 1 which includes an additional agglomeration step to recover coal particle remaining in the suspension of unagglomerated material following the first agglomeration step and subsequent separation and recovery of the initial agglomerates.

20. The process of claim 19 wherein additional coal purification stages are included whin each stage involves resuspending the coal agglomerated from the preceding stage, deagglomerating said agglomerates, reagglomerateing the coal fines, and separating the new agglomerates from the remaining suspension.

* * * * *